US009931740B2

(12) United States Patent
Clifford

(10) Patent No.: US 9,931,740 B2
(45) Date of Patent: Apr. 3, 2018

(54) MULTIPLE BIT ADAPTER

(71) Applicant: Patrick Clifford, Kokomo, IN (US)

(72) Inventor: Patrick Clifford, Kokomo, IN (US)

(73) Assignee: Patrick H. Clifford, Kokomo, IN (US)

( * ) Notice: Subject to any disclaimer, the term of this patent is extended or adjusted under 35 U.S.C. 154(b) by 298 days.

(21) Appl. No.: 15/044,804

(22) Filed: Feb. 16, 2016

(65) Prior Publication Data

US 2017/0232590 A1 Aug. 17, 2017

(51) Int. Cl.
*B25B 23/00* (2006.01)
*B25B 13/06* (2006.01)
*B25B 15/00* (2006.01)

(52) U.S. Cl.
CPC ..... *B25B 23/0035* (2013.01); *B25B 13/06* (2013.01); *B25B 15/005* (2013.01)

(58) Field of Classification Search
CPC . B25B 23/005; B25B 23/0042; B25B 15/004; B25B 15/005; B25B 15/007; B25B 15/008; B25B 13/06; B25G 1/063; B25G 1/085; B25G 1/105
See application file for complete search history.

(56) References Cited

U.S. PATENT DOCUMENTS 5,018,411 A * 5/1991 La Padura ..... B25B 13/56 81/437
D344,664 S 3/1994 Malkinson
5,685,207 A 11/1997 Hubert
5,713,252 A * 2/1998 Iwinski ..... B25B 15/008 81/125.1
6,862,964 B2 * 3/2005 Chen ..... B25B 13/56 81/177.4
7,243,578 B2 7/2007 Burwell
8,051,748 B2 * 11/2011 Lin ..... B25B 15/00 81/177.1
8,307,742 B2 * 11/2012 Hsu ..... B25B 13/56 81/124.3
D674,265 S 1/2013 Greer
8,430,003 B1 * 4/2013 Johnson ..... B23Q 13/00 81/427.5
8,783,138 B2 * 7/2014 Johnson ..... B23Q 13/00 81/439
2013/0014616 A1 1/2013 Putsch et al.

* cited by examiner

*Primary Examiner* — David B Thomas

(57) ABSTRACT

A universal multiple bit adapter is disclosed. The adapter is designed for compatibility with most of the available screws in the construction market including Philip screw, Roberson screw, Torx screw and nut drivers. The multiple bit adapter comprises a cylindrical enclosed housing chamber with plurality of openings to enable selective application of the elongated driver bits. The screw driver bits are made from hardened steel and housing chamber is made from any metal or plastic material. The multi-functional bit adapter unit further comprises a clip protection member to hold the elongated driver bits from rotating further during short repair maintenance. This convenient single unit is small, compact and easy to carry in a pocket and can be easily attached to a power tool like a drill or impact wrench.

15 Claims, 7 Drawing Sheets

MULTIPLE BIT ADAPTER

FIELD OF THE INVENTION

The present invention relates to a convenient hand tool kit and more specifically relates to a combinational adapter unit with multiple screw bits for assembly, maintenance and repair in construction applications.

BACKGROUND OF THE INVENTION

Generally, screw drive system includes screw bits that are used to turn a screw with different drive heads varying in size and dimensions. The usage of these screw bits corresponds to the target application so that the user has to look for the exact one that solves the purpose. In most cases, either user will misplace the bit or else the bit may incur some damages during the service.

Traditionally many screwdriver bit sets have been used in the market by storing all the necessary bits with required sizes in a separate container. However, these are limited to their respective application area and all the required screw bits are not included as a single package due to size constraints. For a construction market, the mechanic or builder has to carry all different type of screw bits to accomplish their purpose. With the separate screw bit storage, they have to lose their productive time in looking for the exact bit and also failing to put back the bit in the storage unit leading to loss of the bit itself. So these separate bit storage kits are not time effective and economical.

Further many universal combinational keysets are available in the prior art which discloses the use of control cabinet keys and screw bits for various applications. Again, these units are application restrictive and does not give efficient results. The prior art applications do not allow the user to use the tool directly with power tool. Commonly used nut drivers are essential tools to be carried by the builder and they have to bring it separately. Most of these combinational units are restrictive in size and dimensions of the screw bits leading to lack of adaptability in the applications, possible failure of assembly of screwdriver bits and screwdriver bit set, as well as adverse impact on the applicability of the screwdriver bit set. Further, all of these units have to be carried in a separate tool box which consumes additional space and adds more complexity to the user. Adding to that, these designs do not provide the required level of torque for driving.

In light of aforementioned problems of screw bits, there exists a need for a single unit adapter with multiple screw driver bits which can be used to cover most of the requirements in the construction market.

SUMMARY OF THE INVENTION

The present invention relates to a multi-functional bit adapter unit that is compact and easy to carry in a pocket and can be easily attached to a power tool like a cordless or AC powered drill or impact drill.

The convenient one unit is a unique structure comprising a cylindrical enclosed housing chamber, wherein a circumferential outer surface of the housing chamber comprises a plurality of openings, wherein one of each opening is in communication with another opening to define a translational path to receive an individual piece unit. The individual piece unit with elongated driver bits are attached to opposing ends of the individual piece unit configured to be removably positioned within the translational path of the housing chamber, thereby enabling selective application of the elongated driver bits for standard fastening requirements, and consolidated storage of the elongated driver bits in a single unit. The housing chamber includes multiple elongated driver bits such as, but not limited to Philips, Robertson, Torx (#20) to Torx (#25) and nut drivers (¼ and 5/16) inches. The drive end is configured to have different sizes and shapes to mate with the standard fastening requirements. The multi-functional bit adapter unit further comprises a protection clip member to hold the elongated driver bits from rotating further during short repair maintenance without the use of a power tool.

In one embodiment, the Philip type driver bit of the size associated with the screw is configured for engagement in the cross-slot shaped recess. In another embodiment, the Robertson type driver bit of the size associated with the screw is configured for engagement in the square shaped recess. In further embodiment, the Torx type driver bit of the size associated with the screw is configured for engagement in the star shaped recess. In one embodiment, the nut driver bit of the size associated with various nut and bolts is configured for tightening purpose. The unit further comprises a housing middle section that is made of any hard metal or plastic material. Individual screw bits are configured to linked to the housing chamber. The proposed invention can be accomplished in two different models. The configuration of the two model units differ in number of elongated driver bits used like four or six different screw bits and nut drivers.

DETAILED DESCRIPTION OF THE INVENTION

Figure 1:
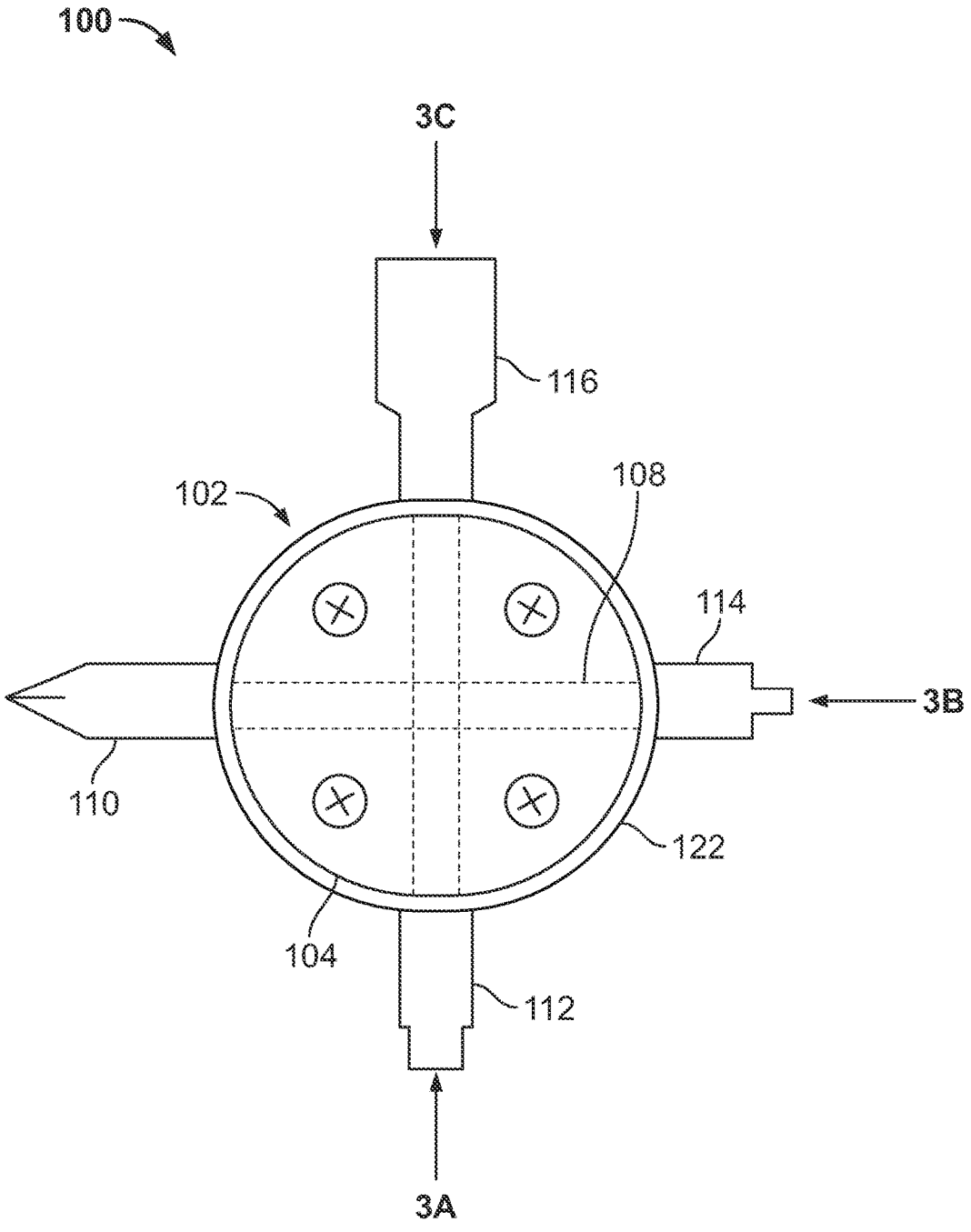
FIG. 1 shows a front view of the four-bit multifunctional adapter unit with multiple elongated driver bits and nut drivers, with a locking adapter according to an embodiment of the present invention.
Figure 2:
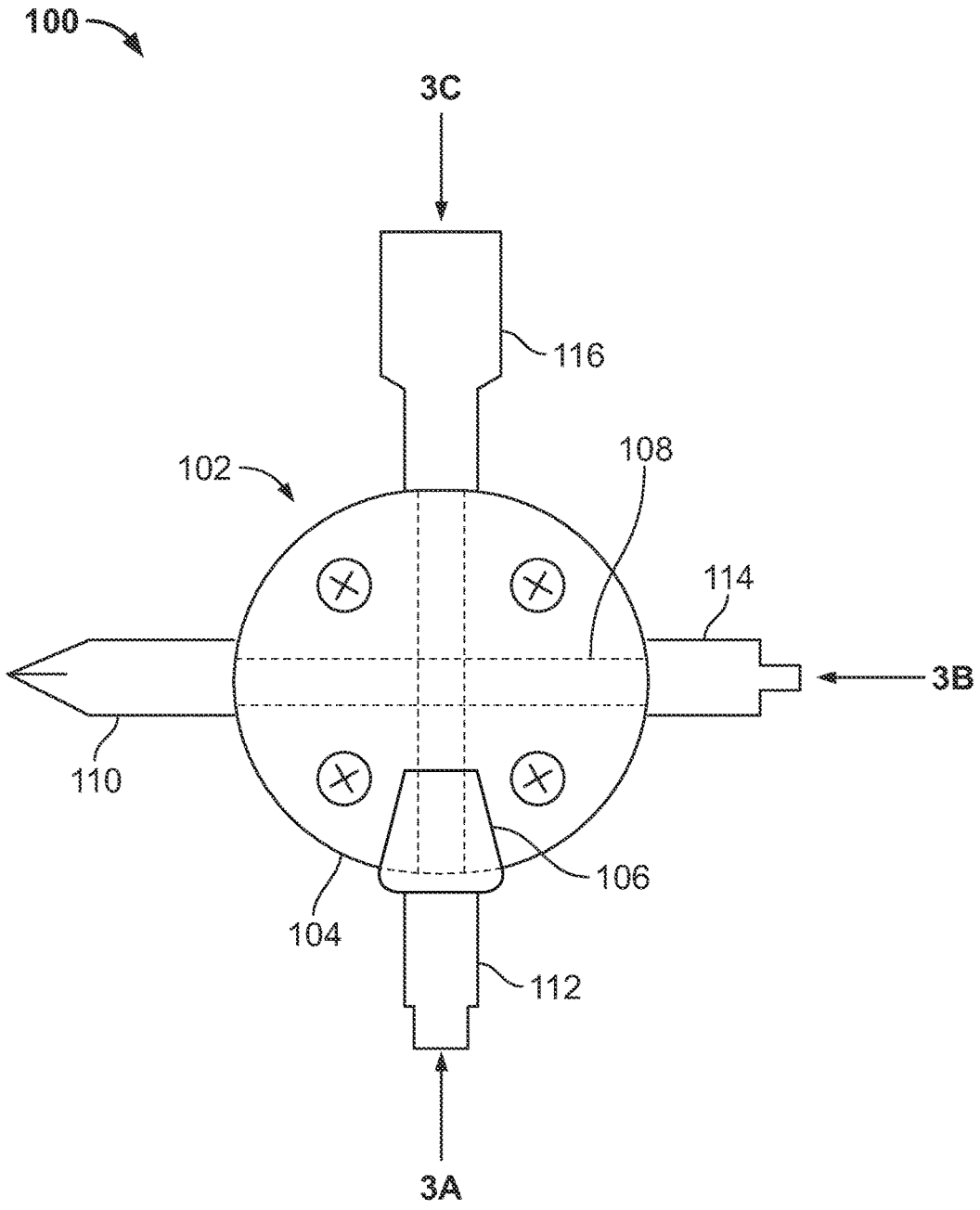
FIG. 2 shows a front view of the four-bit multifunctional adapter unit with multiple elongated driver bits and nut drivers, with a protection clip member according to an embodiment of the present invention.

The present invention according to FIG. 1 shows a four-bit multifunctional adapter unit 100 with multiple elongated driver bits for various fastening applications. The four-bit multifunctional adapter unit 100 comprises a generally cylindrical enclosed housing chamber 102, wherein a circumferential outer surface 104 of the cylindrical enclosed housing chamber 102 comprises plurality of openings, wherein one of each opening is in communication with another opening to define a translational path to receive an individual drive piece unit 108. The individual drive piece unit 108 with elongated driver bits (110, 112, 114, 116) are attached to opposing ends of the individual piece unit 108, configured to be removably positioned within the translational path of the housing chamber 102, thereby enabling selective application of the elongated driver bits for standard fastening requirements, and consolidated storage of the elongated driver bits (110, 112, 114, 116) in a single unit. The cylindrical enclosed housing chamber 102 is assembled either with screws, welded or glued and it is configured in a circular, polygonal and square cross section to receive and store all the elongated driver bits (110, 112, 114, 116). The individual drive piece unit 108 is configured as a one piece unit with either ends having one of the elongated driver bits (110, 112, 114, 116). A clip protection member is configured as one of an individual clip member 106 and a locking adapter ring 122 associated with the cylindrical enclosed housing chamber 102 to lock the elongated driver bits. In an embodiment as shown in FIG. 1, a locking adapter ring 122 is attached to cylindrical enclosed housing chamber 102 to hold the elongated driver bits (110, 112, 114, 116) from rotating further relative to a swivel axis during short repair maintenance without the use of a power tool. This is an alternative method without using the power tool. In an exemplary embodiment as shown in FIG. 2, a one-piece individual protection clip member 106 is used to hold the elongated driver bits from further rotation. The shape, size and configuration of protection member (106, 122) can be varied depending on the size and shape of the cylindrical enclosed housing chamber 102.

Figure 3A:
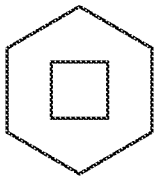
FIG. 3A, FIG. 3B, FIG. 3C shows a front view of the multiple elongated driver bits and nut drivers, according to an embodiment of the present invention.
Figure 3B:
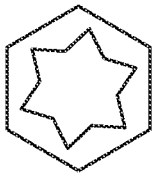
Figure 3C:
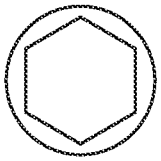

The cylindrical enclosed housing chamber 102 in the four-bit adapter unit 100 comprises multiple elongated driver bits (110, 112, 114, 116) such as, but not limited to Philip screw 110, Torx screw (#25) 112, Roberson screw 114 and nut driver (¼ or 5.16 inches) 116 as shown in FIG. 1. In one embodiment, the Philip type driver bit 110 of the size associated with the screw for engagement in the cross-slot shaped recess. In another embodiment, the Robertson type driver bit 112 of the size associated with the screw for engagement in the square shaped recess as shown in FIG. 3A. In a further embodiment, the Torx type driver bit 112 of the size associated with the screw for engagement in the star shaped recess as shown in FIG. 3B. In one embodiment, the nut driver bit 116 of the size associated with various nut and bolts for tightening purpose as shown in FIG. 3C. In an exemplary embodiment, the nut driver bit 116 is designed in 5/16" or the ¼" inches wherein the 5/16" nut driver head can also be inserted or fitted into any 3/8" chuck drill unit. These elongated driver bits (110, 112, 114, 116) are made from hardened steel to provide significant amount of torque that is required for driving it. Further, the four-bit multifunctional adapter unit 100 is a smaller in size, compact and easy to carry in a pocket. The cylindrical enclosed housing chamber 102 is made from any hard metal or plastic material. The cylindrical enclosed housing chamber 102 comprises of two pieces to hold the elongated driver bits in place. The individual protection clip member 106 will slide over the hex shaft of elongated driver bits (110, 112, 114, 116) and clip to the cylindrical enclosed housing chamber 102 and lock the bit (110, 112, 114, 116) to use multifunctional adapter unit 100 without the power tool.

Figure 4:
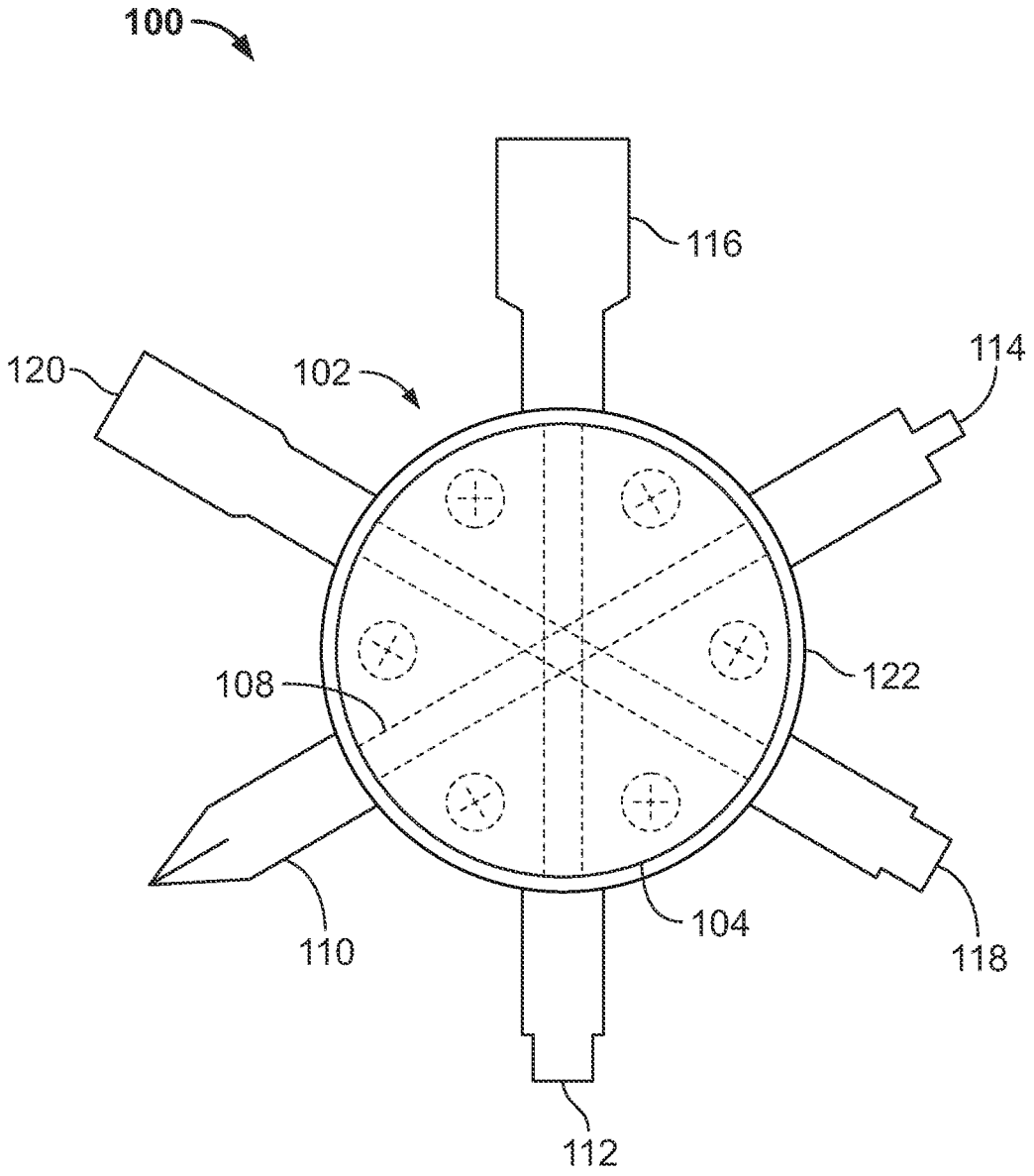
FIG. 4 a front view of the six-bit multifunctional adapter unit with multiple elongated driver bits and nut drivers, with a locking adapter according to an embodiment of the present invention.
Figure 5:
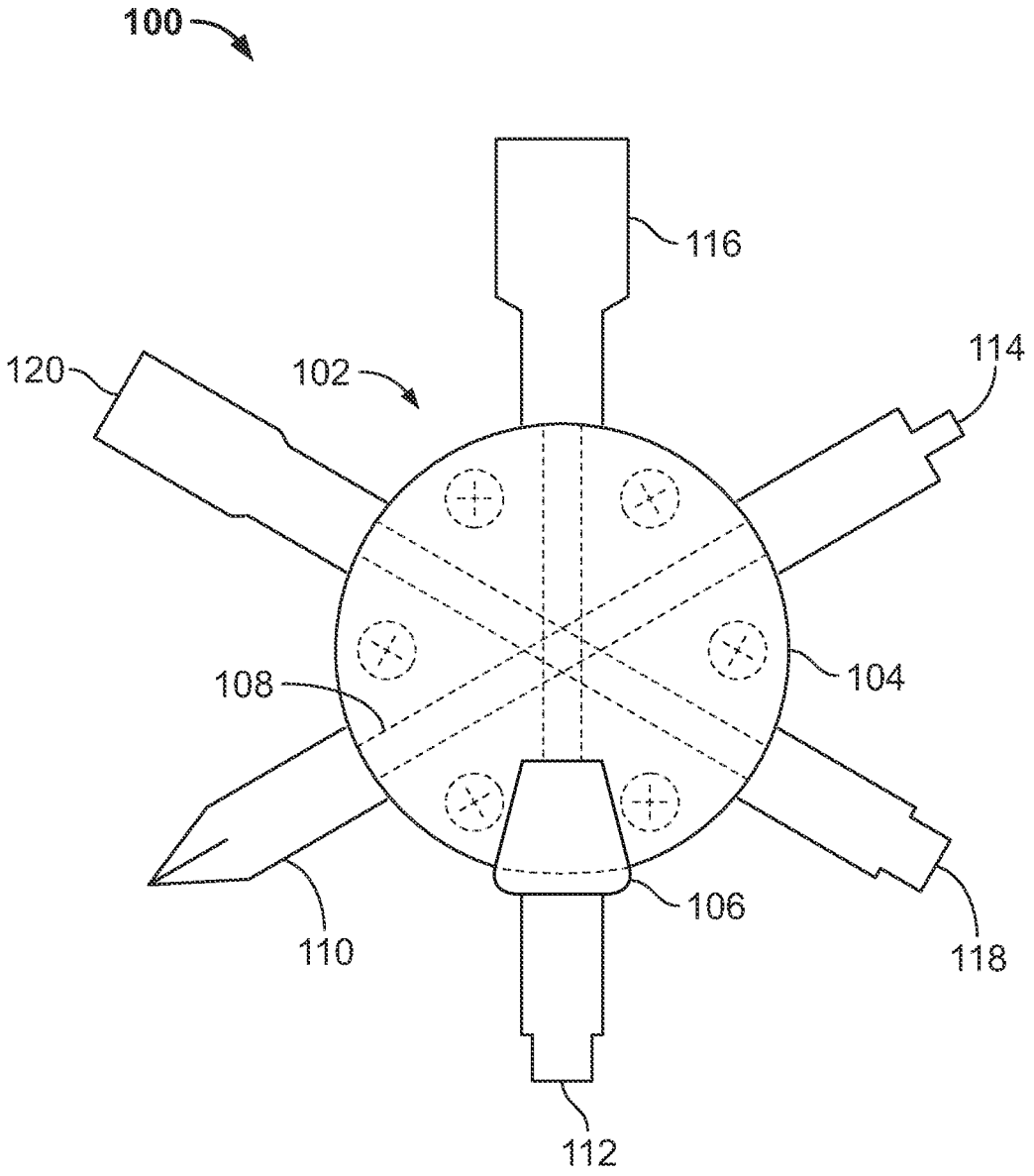
FIG. 5 a front view of the six-bit multifunctional adapter unit with multiple elongated driver bits and nut drivers, with a protection clip member according to an embodiment of the present invention.
Figure 6:
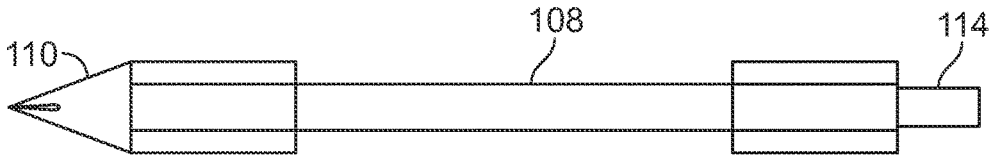
FIG. 6, FIG. 7 shows an individual piece unit with multiple elongated driver bits and nut drivers, according to an embodiment of the present invention.
Figure 7:
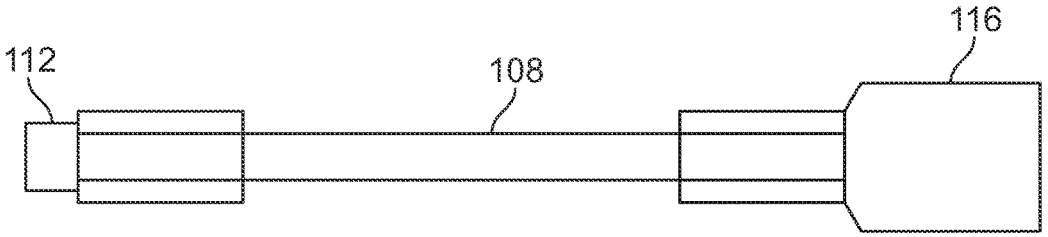

In additional embodiments of the present invention, according to FIG. 4, a six-bit multifunctional adapter unit 100 with multiple elongated driver bits for various fastening applications is disclosed. The six-bit multifunctional adapter unit 100 comprises a generally cylindrical enclosed housing chamber 102, wherein a circumferential outer surface 104 of the cylindrical enclosed housing chamber 102 comprises plurality of openings, wherein one of each opening is in communication with another opening to define a translational path to receive an individual drive piece unit 108. The individual drive piece unit 108 with elongated driver bits (110, 112, 114, 116, 118, 120) are attached to opposing ends of the individual drive piece unit 108, configured to be removably positioned within the translational path of the cylindrical enclosed housing chamber 102, thereby enabling selective applications of the elongated driver bits for standard fastening requirements, and consolidated storage of the elongated driver bits (110, 112, 114, 116, 118, 120) in a single unit. The cylindrical enclosed housing chamber 102 comprises of multiple elongated driver bits (110, 112, 114, 116, 118, 120) such as, but not limited to Philip screw 110, Torx (#25) screw 112, Torx (#20) screw 118, Roberson screw 114, nut driver (5/16 inches) 116 and nut driver (¼ inches) 120. Two nut driver and two Torx star driver bits in the six-bit multifunctional adapter unit 100 that are varying in size and configuration provides additional driving capability. A six-bit multifunctional adapter unit 100 is able to cover almost 80% of the available screws in the construction market. In alternate embodiments as shown in FIG. 4, a locking adapter ring 122 is attached to the cylindrical enclosed housing 102 to hold the elongated driver bits (110, 112, 114, 116, 118, 120) from rotating further, relative to a swivel axis during short repair maintenance without the use of a power tool. This is an alternative method without using the power tool. In an exemplary embodiment as shown in FIG. 5, a one-piece individual protection clip member 106 is used to hold the elongated driver bits from further rotation. The shape, size and configuration of protection member (106, 122) can be varied depending on the size and shape of the cylindrical enclosed housing chamber 102. In an exemplary embodiment, the present invention can be accomplished in two different models as shown in FIG. 1 and FIG. 4 based on number of elongated driver bits used like four or six different elongated driver bits. FIG. 6 according to the present invention, shows an individual drive piece unit 108 of the four-bit adapter unit 100 wherein the two ends of the individual drive piece unit 108 is configured to have two different driver bit configuration like Philip screw 110 and Roberson screw 114 to mate with the standard fastening requirements. The individual drive piece unit 108 is adjustable with respect to the cylindrical enclosed housing chamber 102 so that the user can leverage and improve the capabilities of the unit. Further, this individual drive piece unit 108 can have distinguishing driver heads including all the six elongated driver bits (110, 112, 114, 116, 118, 120) as shown in FIG. 7. This convenient single unit covers most of the screw drive fastening applications with additional nut drivers to allow for improving the adaptability and applicability as well as a need for separate storage is eliminated. Further, this convenient combination unit gives an advantage for contractor, mechanic, or builder to save more time while looking for the exact elongated driver bit. In addition, both the four and the six-bit adapter unit 100 are removably attached to a power tool like a drill or impact wrench applications.

Figure 8:
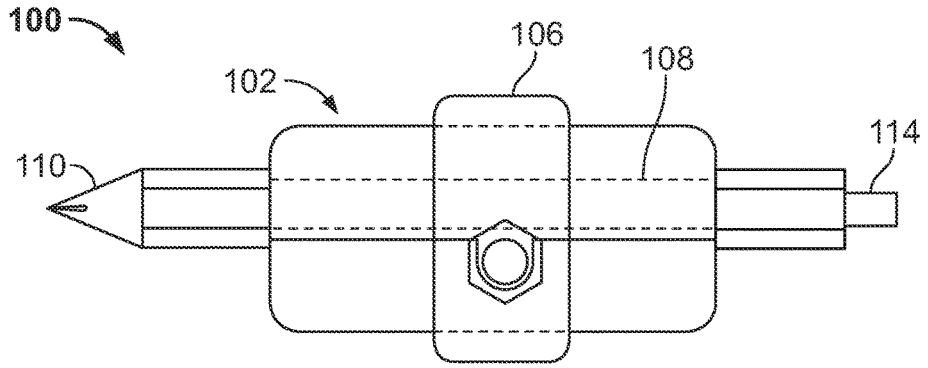
FIG. 8, FIG. 9, FIG. 10 shows the side views of protection clip member and locking adapter attached to the multifunctional adapter unit with multiple elongated driver bits and nut drivers, according to an embodiment of the present invention.
Figure 9:
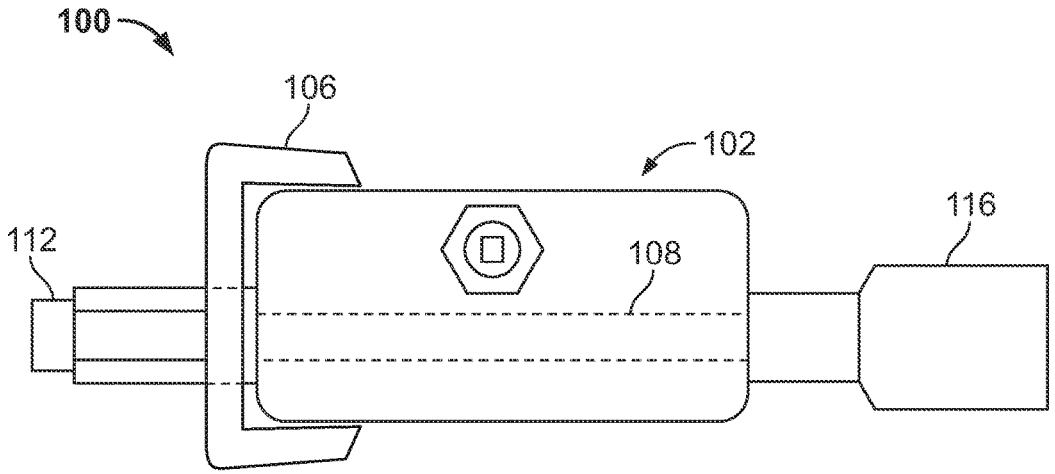
Figure 10:
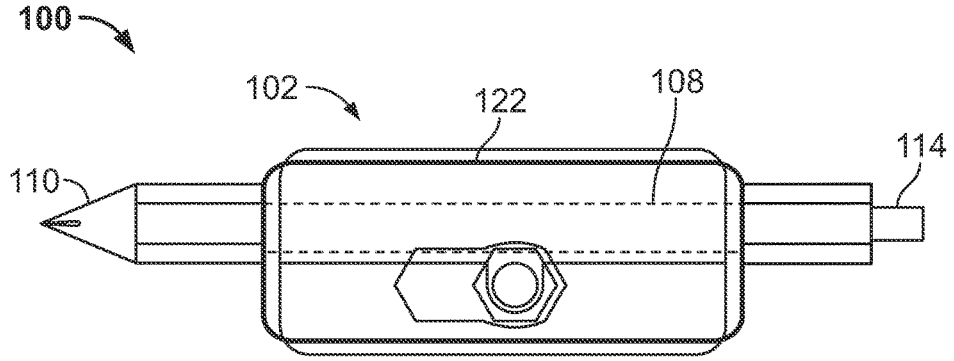

In an exemplary embodiment as shown in FIG. 8, FIG. 9 and FIG. 10 which shows a unit 100 wherein an individual protection clip member 106 is shown attached to the cylindrical enclosed housing chamber 102. The individual protection clip member 106 is disposed for preventing the elongated driver bits from rotating relative to a swivel axis. In alternate embodiments, the protection member can be configured as an individual clip member 106 or a locking adapter ring 122 around the housing to get twisted into the elongated driver bit for locking purpose. As shown in FIG. 9 which is the side view of the individual clip member 106 to hold the elongated driver bits from further rotation. FIG. 10 shows a locking adapter ring 122 disposed around the housing 102 to prevent the elongated driver bits from rotating about any swivel axis.

Although the present invention has been described herein in the context of a particular implementation in a particular environment for a particular purpose, those of ordinary skill in the art will recognize that its usefulness is not limited to, and that the present invention may be beneficially implemented in any number of environments for any number of purposes. Accordingly, the claims set forth below should be construed in view of the full breadth and spirit of the present invention as described herein. Although specific terms may be employed herein, they are used in a generic and descriptive sense only and not for purposes of limitation.

The invention claimed is:

1. A multi-functional bit adapter comprising:

a generally cylindrical enclosed housing chamber, wherein a circumferential outer surface of the housing chamber comprises plurality of openings, wherein one of each opening is in communication with another opening to define a translational path to receive an individual piece unit; and the individual piece unit with elongated driver bits attached to opposing ends of the individual piece unit, configured to be removably positioned within the translational path of the housing chamber, thereby enabling selective application of the elongated driver bits for standard fastening requirements, and consolidated storage of the elongated driver bits in a single unit.

2. The multi-functional bit adapter of claim 1, further comprising a protection member configured in a predetermined position with respect to the housing chamber for preventing the elongated driver bits from rotating relative to a swivel axis.

3. The multi-functional bit adapter of claim 2, wherein the protection member is a clip configured as one of an individual member and a locking adapter ring associated with the housing to lock the elongated driver bits.

4. The multi-functional bit adapter of claim 2, wherein the Philip type driver bit of the size associated with the screw is configured for engagement in a cross-slot shaped recess.

5. The multi-functional bit adapter of claim 2, wherein the Robertson type driver bit of the size associated with the screw is configured for engagement in the square shaped recess.

6. The multi-functional bit adapter of claim 2, wherein the Torx type driver bit of the size associated with the screw is configured for engagement in the star shaped recess.

7. The multi-functional bit adapter of claim 2, wherein the nut driver bit of the size associated with various nut and bolts is configured for tightening purpose.

8. The multi-functional bit adapter of claim 1, wherein the enclosed housing chamber comprises different driver bits within a range of four to six types, and further comprises a Philip screw, a Roberson screw, a Torx screw and a nut driver.

9. The multi-functional bit adapter of claim 1, wherein the adapter unit is of a predefined size, and is configured to be carried in a pocket.

10. The multi-functional bit adapter of claim 1, wherein the housing is made from one of a hard metal and a plastic material.

11. The multi-functional bit adapter of claim 1, wherein the driver bits are made of a hard steel material.

12. The multi-functional bit adapter of claim 1, wherein the housing is configured in a circular, polygonal, and square cross section, wherein the housing is configured to store all the elongated driver bits.

13. The multi-functional bit adapter of claim 1, wherein the drive end of the elongated driver bits is configured to be removably attached to a power tool device.

14. A four-bit multifunctional adapter comprising:

a generally cylindrical enclosed housing chamber, wherein a circumferential outer surface of the housing chamber comprises plurality of openings, wherein one of each opening is in communication with another opening to define a translational path to receive an individual piece unit; and the individual piece unit with four elongated driver bits attached to opposing ends of the individual piece unit configured to be removably positioned within the translational path of the housing chamber, thereby enabling selective application of the elongated driver bits for standard fastening requirements, and consolidated storage of the elongated driver bits in a single unit.

15. A six-bit multifunctional adapter comprising:

a generally cylindrical enclosed housing chamber, wherein a circumferential outer surface of the housing chamber comprises plurality of openings, wherein one of each opening is in communication with another opening to define a translational path to receive an individual piece unit; and the individual piece unit with six elongated driver bits attached to opposing ends of the individual piece unit configured to be removably positioned within the translational path of the housing chamber, thereby enabling selective application of the elongated driver bits for standard fastening requirements, and consolidated storage of the elongated driver bits in a single unit.

* * * * *